US009748675B2

(12) United States Patent
Syck et al.

(10) Patent No.: US 9,748,675 B2
(45) Date of Patent: Aug. 29, 2017

(54) SYSTEMS AND METHODS FOR SPLICING WIRES

(71) Applicant: General Electric Company, Schenectady, NY (US)

(72) Inventors: David Howard Syck, Mableton, GA (US); Gregory Quentin Brown, Simpsonville, SC (US); Kurt Kramer Schleif, Greenville, SC (US); Andrea Booher Kretschmar, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 195 days.

(21) Appl. No.: 14/472,727

(22) Filed: Aug. 29, 2014

(65) Prior Publication Data

US 2016/0064835 A1 Mar. 3, 2016

(51) Int. Cl.
*H01R 4/70* (2006.01)
*H01R 4/10* (2006.01)
*H01R 4/20* (2006.01)

(52) U.S. Cl.
CPC ..... *H01R 4/70* (2013.01); *H01R 4/10* (2013.01); *H01R 4/20* (2013.01)

(58) Field of Classification Search
CPC ..... H02G 15/18
USPC ..... 174/88 R
See application file for complete search history.

(56) References Cited

U.S. PATENT DOCUMENTS 5,422,438 A * 6/1995 Lamome ..... H01R 4/203 174/76
6,677,529 B1 * 1/2004 Endacott ..... H01R 4/187 174/84 C
2006/0108140 A1 * 5/2006 Wiley ..... H01R 4/04 174/84 R
2012/0318576 A1 * 12/2012 Koto ..... H01R 4/723 174/88 R

OTHER PUBLICATIONS

Syck, David H., "Wilkie Splicer" disclosure.

* cited by examiner

*Primary Examiner* — Hoa C Nguyen
*Assistant Examiner* — Stanley Tso
(74) *Attorney, Agent, or Firm* — Eversheds Sutherland (US) LLP

(57) ABSTRACT

A splicer device is disclosed herein. The splicer device includes a main body having an internal passage formed between a first end of the main body and a second end of the main body. The first end of the main body is configured to receive at least one first wire, and the second end of the main body is configured to receive at least one second wire. A window is disposed within the main body and in communication with the internal passage between the first end of the main body and the second end of the main body for accessing and splicing the at least one first wire and the at least one second wire.

12 Claims, 6 Drawing Sheets

SYSTEMS AND METHODS FOR SPLICING WIRES

FIELD OF THE DISCLOSURE

The disclosure generally relates to a splicer device and more particularly relates to systems and methods for splicing two or more wires.

BACKGROUND

In electrical wiring, it may be necessary to connect multiple segments of wire. Splicing wire is the process of joining two or more pieces of wire together. However, joining two or more pieces of wire together may be difficult due to the different types of wire and the varying diameters of wire. Accordingly, what is needed is a splicer device that enables the splicing of different diameter wires and wire types for a secure mechanical and electrical joint.

SUMMARY

Some or all of the above needs and/or problems may be addressed by certain embodiments of the splicer device disclosed herein. According to an embodiment, the splicer device may include a main body having an internal passage formed between a first end of the main body and a second end of the main body. The first end of the main body may be configured to receive at least one first wire, and the second end of the main body may be configured to receive at least one second wire. A window may be disposed within the main body and in communication with the internal passage between the first end of the main body and the second end of the main body for accessing and splicing the at least one first wire and the at least one second wire.

In another embodiment, a method of splicing at least one first wire and at least one second wire is disclosed. The method may include inserting the at least one first wire into a first end of a main body through an internal passage of the main body. The method also may include inserting the at least one second wire into a second end of the main body through the internal passage of the main body. In addition, the method may include accessing the at least one first wire and the at least one second wire at a window disposed within the main body and in communication with the internal passage between the first end of the main body and the second end of the main body. Moreover, the method may include splicing the at least one first wire and the at least one second wire.

In yet another embodiment, the splicer device may include a tubular main body having an internal passage therethrough. The splicer device also may include a first end of the main body configured to receive at least one first wire. In addition, the splicer device may include a second end of the main body configured to receive at least one second wire. A window may be disposed within the main body and in communication with the internal passage between the first end of the main body and the second end of the main body for accessing and splicing the at least one first wire and the at least one second wire. Moreover, the splicer device may include a non-conductive material disposed within the window after the at least one first wire and the at least one second wire are spliced together.

Other features and aspects of the splicer device will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
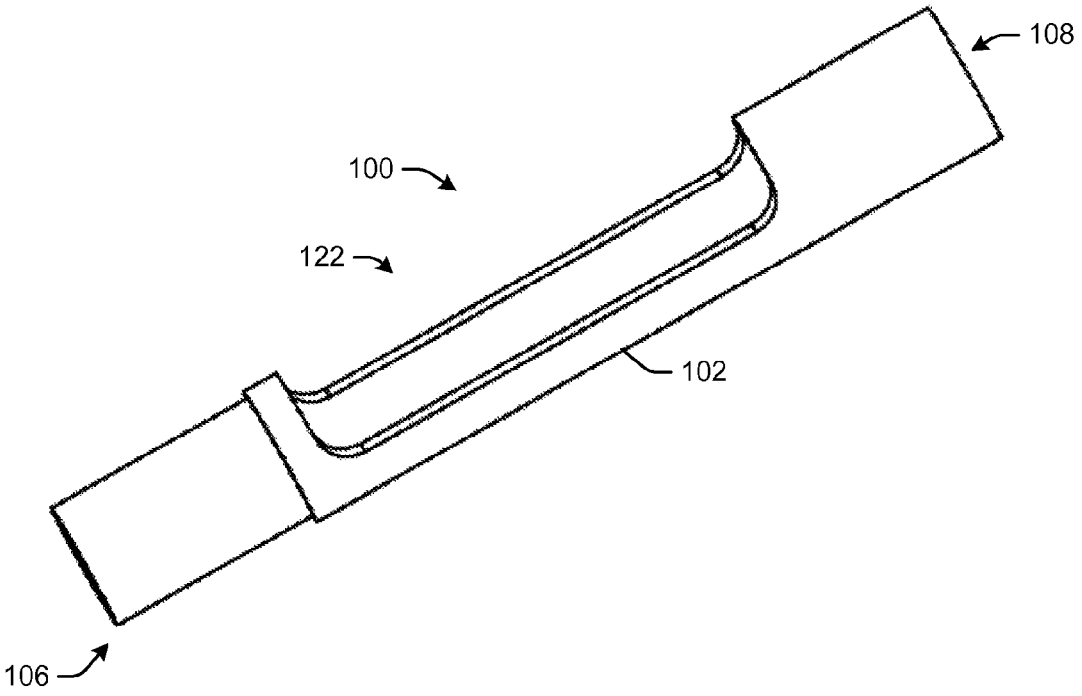
FIG. 1 schematically depicts perspective view of a splicer device in accordance with one or more embodiments of the disclosure.

Described below are embodiments of a splicer device that may be used to splice (i.e., connect) two or more wires. The splicer device enables the splicing of different diameter wires and wire types for a secure mechanical and electrical joint. The splicer device may be used to splice any number of wires. Moreover, the splicer device may be used to splice various types of wires. For example, in one embodiment, the splicer device may be used to splice a four conductor ⅛ inch magnesium oxide insulated stainless steel sheathed wire with two stainless steel overbraid/fiberglass insulated constantine/constantine twisted conductor wires. Any types of wire may be spliced together. The examples discussed herein are but a few of many.

In certain embodiments, the splicer device may include a main body. The main body may include an internal passage formed between a first end of the main body and a second end of the main body. In some instances, the main body may be substantially tubular. The main body may be any suitable shape or size. The first end of the main body may be configured to receive at least one first wire. The at least one first wire may be a single wire or a number of wires. Moreover, an end of the at least one first wire may be at least partially stripped to expose one or more conductors therein. Likewise, the second end of the main body may be configured to receive at least one second wire. The at least one second wire may be a single wire or a number of wires. Moreover, an end of the at least one second wire may be at least partially stripped to expose one or more conductors therein.

A portion of the first end of the main body may be configured to be crimped about the at least one first wire to secure the at least one first wire within the main body. Likewise, a portion of the second end of the main body may be configured to be crimped about the at least one second wire to secure the at least one second wire within the main body. In some instances, the first end of the main body may include a diameter that is smaller than the second end of the main body or vice versa.

A window may be disposed within the main body. The window may be in communication with the internal passage. For example, the window may be disposed between the first end of the main body and the second end of the main body and extend through the main body to the internal passage. In this manner, the window may provide access to the at least one first wire and the at least one second wire within the main body so as to enable splicing of the at least one first wire and the at least one second wire.

In some instances, a non-conductive material may be disposed within the window after the at least one first wire and the at least one second wire are spliced together within the main body. The non-conductive material may insulate the internal passage. Moreover, a cover may be disposed over the window after the window is filled with the non-conductive material. In some instances, the cover may comprise shimstock, such as NiCr shimstock. The cover may be any suitable material.

Figure 2:
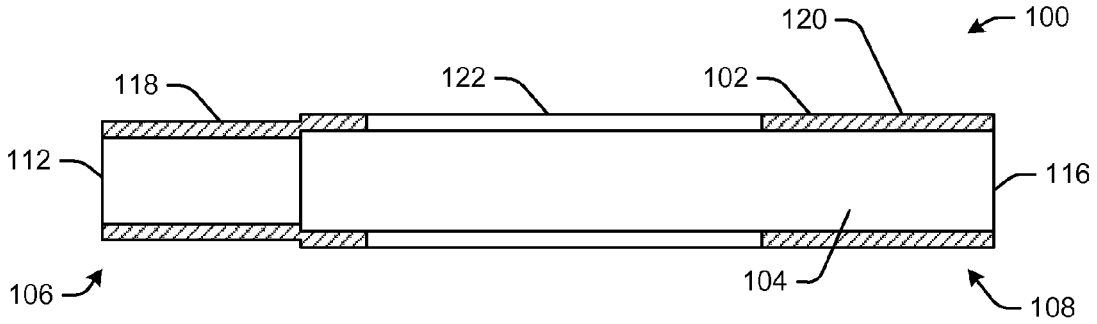
FIG. 2 schematically depicts a cross sectional view of a splicer device in accordance with one or more embodiments of the disclosure.
Figure 3:
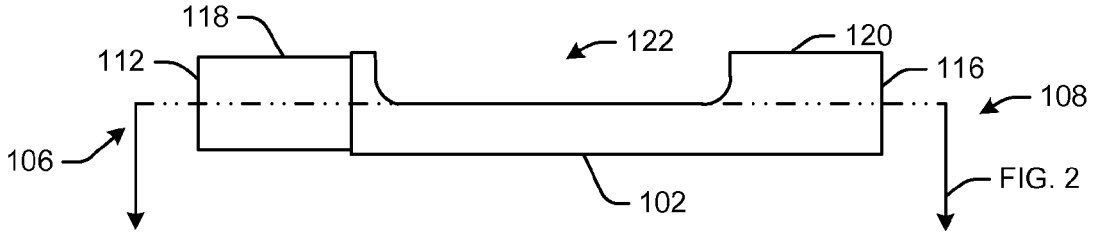
FIG. 3 schematically depicts a side view of a splicer device in accordance with one or more embodiments of the disclosure.
Figure 4:
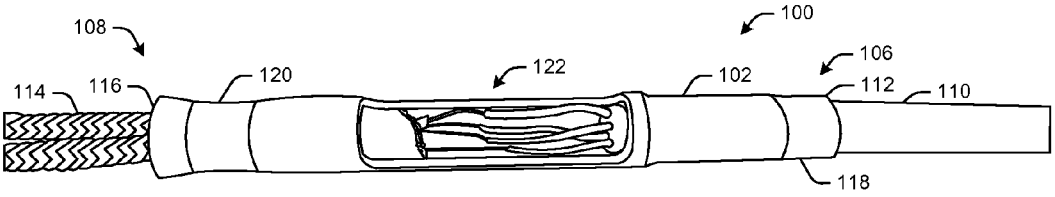
FIG. 4 schematically depicts a perspective view of a splicer device in accordance with one or more embodiments of the disclosure.
Figure 5:
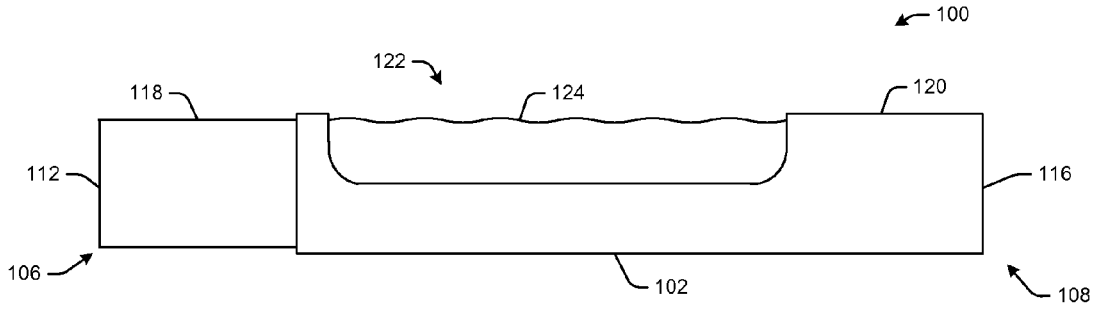
FIG. 5 schematically depicts a side view of a splicer device in accordance with one or more embodiments of the disclosure.
Figure 6:
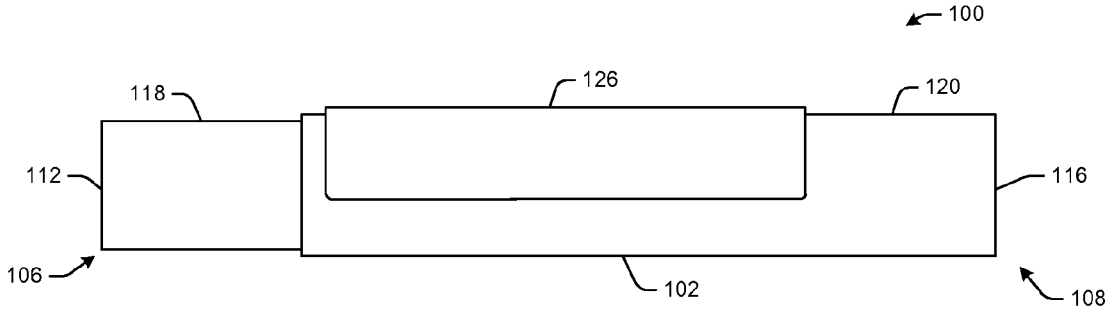
FIG. 6 schematically depicts a side view of a splicer device in accordance with one or more embodiments of the disclosure.

Turning now to the drawings, FIGS. 1-6 schematically depict a splicer device 100. The splicer device 100 may include a main body 102. The main body 102 may include an internal passage 104 formed between a first end 106 of the main body 102 and a second end 108 of the main body 102. That is, the internal passage 104 may extend the length of the main body 102. The internal passage 104 may be any diameter or shape. For example, the internal passage 104 may include a constant diameter or a varying diameter. Moreover, the main body 102 (and the internal passage 104) may be substantially linear or substantially curved. In some instances, the main body 102 may be substantially tubular. The main body 102 may be any suitable shape or size.

The first end 106 of the main body 102 may be configured to receive at least one first wire 110. For example, the first end 106 of the main body 102 may include a first opening 112 in communication with the internal passage 104. In this manner, the at least one first wire 110 may be inserted into the first opening 112 and advanced into the internal passage 104. Likewise, the second end 108 of the main body 102 may be configured to receive at least one second wire 114. For example, the second end 108 of the main body 102 may include a second opening 116 in communication with the internal passage 104. In this manner, the at least one second wire 114 may be inserted into the second opening 116 and advanced into the internal passage 104.

A portion 118 of the first end 106 of the main body 102 may be configured to be crimped (or compressed) around the at least one first wire 110 to secure the at least one first wire 110 within the main body 102. Likewise, a portion 120 of the second end 108 of the main body 102 may be configured to be crimped (or compressed) around the at least one second wire 114 to secure the at least one second wire 114 within the main body 102. In some instances, the first end 106 of the main body 102 may include a diameter that is smaller than the second end 108 of the main body 102. The diameter of the first end 106 of the main body 102 and the second end 108 of the main body 102 may vary. Moreover, the diameter of the first end 106 of the main body 102 and the second end 108 of the main body 102 may be at least partially dependent on the size and shape of the wires inserted therein.

A window 122 may be disposed within the main body 102. In some instances, the window 122 may be a cutout portion of the main body 102. The window 122 may be in communication with the internal passage 104. In this manner, the window 122 may provide access to the internal passage 104. For example, the window 122 may be disposed between the first end 106 of the main body 102 and the second end 108 of the main body 102 and extend through the main body 102 to the internal passage 104. In this manner, the window 122 may provide access to the at least one first wire 110 and the at least one second wire 114 within the internal passage 104 of the main body 102 so as to enable splicing of the at least one first wire 110 and the at least one second wire 114.

In some instances, a non-conductive material 124 may be disposed within the window 122 after the at least one first wire 110 and the at least one second wire 114 are spliced together within the internal passage 104 of the main body 102. For example, the non-conductive material 124 may be injected into the internal passage 104 at the window 122. The non-conductive material 124 may fill in the window 122 and encase the at least one first wire 110 and the at least one second wire 114. The non-conductive material 124 may be any material, including non-conductive cement or the like. Moreover, a cover 126 may be disposed over the window 122 after the window 122 is filled with the non-conductive material 124. In some instances, the cover 126 may comprise shimstock, such as NiCr shimstock.

In use, the at least one first wire 110 may be interested into the first opening 112 at first end 110 of the main body 102 through the internal passage 104 of the main body 102. In some instances, the at least one first wire 110 may be a four conductor ⅛ inch magnesium oxide insulated stainless steel sheathed wire. Similarly, the at least one second wire 114 may be inserted into the second opening 116 at the second end 108 of the main body 102 through the internal passage 104 of the main body 102. In some instances, the at least one second wire may include two stainless steel overbraid/fiberglass insulated constantine/constantine twisted conductor wires.

The at least one first wire 110 and the at least one second wire 114 may be inserted into the internal passageway 104 to the window 122. Once the ends of the wires are positioned about the window 122, a portion 118 of the first end 106 of the main body 102 may be crimped about the at least one first wire 110 to secure the at least one first wire 110 within the main body 102. Likewise, a portion 120 of the second end 108 of the main body 102 may be crimped about the at least one second wire 114 to secure the at least one second wire 114 within the main body 102. At the window 122, the at least one first wire 110 and the at least one second wire 114 may be spliced together. For example, the various conductive components of the wires may be attached together by a user through the window 122.

After the at least one first wire 110 and the at least one second wire 114 are spliced together, the window 122 may be filled with a non-conductive material 124. In addition, after the window 122 is filled with the non-conductive material 124, the window 122 may be covered with a cover 126.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A splicer device, comprising:

a main body comprising an internal passage formed between a first end of the main body and a second end of the main body, wherein the first end of the main body is configured to receive at least one first wire, and wherein the second end of the main body is configured to receive at least one second wire;

a window disposed within the main body and in communication with the internal passage between the first end of the main body and the second end of the main body for accessing and splicing the at least one first wire and the at least one second wire;

a non-conductive material disposed within the window around a spliced together portion of the at least one first wire and the at least one second wire, wherein the non-conductive material is disposed within the window inside the main body at the spliced together portion of the at least one first wire and the at least one second wire to encase the spliced together portion of the at least one first wire and the at least one second wire; and a metallic cover disposed over the window, wherein the window comprises a 180 degree opening in a radial direction, wherein the window further comprises a length in an axial direction greater than a length of the first end portion in the axial direction plus a length of the second end portion of the main body in the axial direction.

2. The splicer device of claim 1, wherein the first end of the main body comprises a diameter that is smaller than the second end of the main body or vice versa.

3. The splicer device of claim 1, wherein a portion of the first end of the main body is configured to be crimped about the at least one first wire.

4. The splicer device of claim 1, wherein a portion of the second end of the main body is configured to be crimped about the at least one second wire.

5. The splicer device of claim 1, wherein the at least one first wire comprises a four conductor ⅛ inch magnesium oxide insulated stainless steel sheathed wire.

6. The splicer device of claim 1, wherein the at least one second wire comprises two stainless steel overbraid/fiberglass insulated constantine/constantine twisted conductor wires.

7. The splicer device of claim 1, wherein the main body is substantially tubular.

8. A splicer device, comprising:

a tubular main body comprising an internal passage therethrough;

a first end of the main body being configured to receive at least one first wire;

a second end of the main body being configured to receive at least one second wire;

a window disposed within the main body and in communication with the internal passage between the first end of the main body and the second end of the main body for accessing and splicing the at least one first wire and the at least one second wire;

a non-conductive material disposed within the window around and about a spliced together portion of the at least one first wire and the at least one second wire, wherein the non-conductive material is disposed within the window inside the main body at the spliced together portion of the at least one first wire and the at least one second wire to encase the spliced together portion of the at least one first wire and the at least one second wire; and a metallic shimstock cover disposed over the window about the non-conductive material disposed therein, wherein the window comprises a 180 degree opening in a radial direction, wherein the window further comprises a length in an axial direction greater than a length of the first end portion in the axial direction plus a length of the second end portion of the main body in the axial direction.

9. The splicer device of claim 8, wherein a portion of the first end of the main body is configured to be crimped about the at least one first wire.

10. The splicer device of claim 8, wherein a portion of the second end of the main body is configured to be crimped about the at least one second wire.

11. The splicer device of claim 8, wherein the at least one first wire comprises a four conductor ⅛ inch magnesium oxide insulated stainless steel sheathed wire.

12. The splicer device of claim 8, wherein the at least one second wire comprises two stainless steel overbraid/fiberglass insulated constantine/constantine twisted conductor wires.

* * * * *